US010170867B2

(12) United States Patent
Ju et al.

(10) Patent No.: US 10,170,867 B2
(45) Date of Patent: Jan. 1, 2019

(54) ELECTRICAL CONNECTOR

(71) Applicant: LOTES CO., LTD, Keelung (TW)

(72) Inventors: Ted Ju, Keelung (TW); Wu Feng, Keelung (TW); Ya Jun Zeng, Keelung (TW); Nan Fang He, Keelung (TW); Jun Fan, Keelung (TW); Jin Ke Hu, Keelung (TW); Guo Sheng Zhou, Keelung (TW); Chin Chi Lin, Keelung (TW)

(73) Assignee: LOTES CO., LTD, Keelung (TW)

( * ) Notice: Subject to any disclaimer, the term of this patent is extended or adjusted under 35 U.S.C. 154(b) by 17 days.

(21) Appl. No.: 15/648,773

(22) Filed: Jul. 13, 2017

(65) Prior Publication Data

US 2017/0310058 A1 Oct. 26, 2017

Related U.S. Application Data

(63) Continuation of application No. 15/263,413, filed on Sep. 13, 2016, which is a continuation of application No. 14/626,709, filed on Feb. 19, 2015.
(Continued)

(51) Int. Cl.
*H01R 13/648* (2006.01)
*H01R 13/6585* (2011.01)
(Continued)

(52) U.S. Cl.
CPC ..... *H01R 13/6585* (2013.01); *H01R 12/724* (2013.01); *H01R 13/6581* (2013.01);
(Continued)

(58) Field of Classification Search
CPC ..... H01R 13/6594; H01R 13/6585
(Continued)

(56) References Cited

U.S. PATENT DOCUMENTS 7,758,379 B2 * 7/2010 Chen ..... H01R 13/6485 439/607.11
8,968,031 B2 * 3/2015 Simmel ..... H01R 13/659 439/108
(Continued)

FOREIGN PATENT DOCUMENTS

CN 203445352 U 2/2014
TW 201532347 A 8/2015

*Primary Examiner* — Neil Abrams
(74) *Attorney, Agent, or Firm* — Locke Lord LLP; Tim Tingkang Xia, Esq.

(57) ABSTRACT

An electrical connector includes an insulation body having a base and a tongue located in a front end of the base, terminals arranged in upper and lower rows, and a middle grounding plate disposed in the base and extending to the tongue. Terminals in the upper and lower rows are arranged on upper and lower surfaces of the tongue, respectively. The middle grounding plate is located between the upper and lower rows of terminals, and having at least one first hole. An edge of each of two lateral sides of the middle grounding plate is inwardly depressed to form a first groove. The first hole is located between the two first grooves. The insulation body has a first insulation post and a second insulation post, the first insulation post protrudes into the first hole, and the second insulation post protrudes into the first grooves on the lateral sides.

20 Claims, 9 Drawing Sheets

Related U.S. Application Data

(60) Provisional application No. 62/024,728, filed on Jul. 15, 2014, provisional application No. 61/942,830, filed on Feb. 21, 2014.

(51) Int. Cl.

| | |
|---|---|
| ***H01R 24/60*** | (2011.01) |
| ***H01R 13/6581*** | (2011.01) |
| ***H01R 13/6591*** | (2011.01) |
| ***H01R 12/72*** | (2011.01) |
| ***H01R 13/6583*** | (2011.01) |
| ***H01R 13/6594*** | (2011.01) |
| *H01R 107/00* | (2006.01) |

(52) U.S. Cl.
CPC ..... *H01R 13/6583* (2013.01); *H01R 13/6591* (2013.01); *H01R 13/6594* (2013.01); *H01R 24/60* (2013.01); *H01R 2107/00* (2013.01)

(58) Field of Classification Search
USPC ..... 439/607.09, 607.11
See application file for complete search history.

(56) References Cited

U.S. PATENT DOCUMENTS

| | | | | |
|---|---|---|---|---|
| 9,178,319 | B2 * | 11/2015 | Little | H01R 13/6585 |
| 9,231,356 | B1 * | 1/2016 | Ju | H01R 24/78 |
| 9,252,542 | B2 * | 2/2016 | Little | H01R 13/6585 |
| 9,306,337 | B2 * | 4/2016 | Yu | H01R 24/60 |
| 9,312,641 | B2 * | 4/2016 | Wang | H01R 13/6585 |
| 9,379,494 | B1 * | 6/2016 | Hu | H01R 13/6594 |
| 9,484,679 | B2 * | 11/2016 | Guo | H01R 13/6585 |
| 9,490,580 | B2 * | 11/2016 | Lan | H01R 13/646 |
| 9,502,821 | B2 * | 11/2016 | Little | H01R 13/6582 |
| 9,502,837 | B2 * | 11/2016 | Kao | H01R 24/60 |
| 9,525,244 | B1 * | 12/2016 | Hsu | H01R 13/6585 |
| 9,531,134 | B2 * | 12/2016 | Peng | H01R 13/6585 |
| 9,537,263 | B2 * | 1/2017 | Gao | H01R 13/6582 |
| 9,577,373 | B2 * | 2/2017 | Kato | H01R 13/405 |
| 9,590,360 | B2 * | 3/2017 | Chuang | H01R 13/6581 |
| 9,590,364 | B1 * | 3/2017 | Chang | H01R 13/6581 |
| 9,627,817 | B2 * | 4/2017 | Chang | H01R 13/6594 |
| 9,667,001 | B2 * | 5/2017 | Zhao | H01R 13/6581 |
| 9,673,569 | B2 * | 6/2017 | Zhang | H01R 13/6585 |
| 9,680,260 | B2 * | 6/2017 | Fan | H01R 13/6585 |
| 9,692,166 | B2 * | 6/2017 | Kao | H01R 13/42 |
| 9,698,536 | B2 * | 7/2017 | Little | H01R 13/6583 |
| 9,698,541 | B2 * | 7/2017 | Tsai | H01R 13/6595 |
| 9,705,267 | B2 * | 7/2017 | Cheng | H01R 24/60 |
| 9,722,369 | B1 * | 8/2017 | Hsu | H01R 24/60 |
| 9,728,885 | B2 * | 8/2017 | Yokoyama | H01R 13/502 |
| 9,728,899 | B2 * | 8/2017 | Peng | H01R 13/6581 |
| 9,742,098 | B2 * | 8/2017 | Zhao | H01R 13/5202 |
| 9,742,123 | B2 * | 8/2017 | Yokoyama | H01R 13/6591 |
| 9,742,125 | B2 * | 8/2017 | Zhao | H01R 13/6594 |
| 9,780,468 | B2 * | 10/2017 | Yokoyama | H01R 12/7047 |
| 9,780,496 | B2 * | 10/2017 | Guo | H01R 13/6585 |
| 9,780,505 | B2 * | 10/2017 | Peng | H01R 24/60 |
| 9,787,008 | B2 * | 10/2017 | Gou | H01R 12/53 |
| 9,812,816 | B2 * | 11/2017 | Imai | H01R 13/6581 |
| 9,831,615 | B2 * | 11/2017 | Saito | H01R 13/6596 |
| 9,837,772 | B2 * | 12/2017 | Tsai | H01R 24/60 |
| 9,843,148 | B2 * | 12/2017 | Little | H01R 24/60 |
| 9,853,387 | B2 * | 12/2017 | Dai | H01R 13/405 |
| 9,853,399 | B2 * | 12/2017 | Kao | H01R 13/6585 |
| 9,859,661 | B2 * | 1/2018 | Park | H01R 13/6585 |
| 9,865,962 | B2 * | 1/2018 | Zhao | H01R 13/5202 |
| 9,865,974 | B2 * | 1/2018 | Chen | H01R 24/62 |
| 9,871,326 | B2 * | 1/2018 | Zhao | H01R 13/6581 |
| 9,876,318 | B2 * | 1/2018 | Gao | H01R 13/6582 |
| 9,882,316 | B2 * | 1/2018 | Chen | H01R 13/6585 |
| 9,882,322 | B2 * | 1/2018 | Chung | H01R 24/60 |
| 9,887,485 | B2 * | 2/2018 | Lambie | H01R 13/5219 |
| 9,893,473 | B2 * | 2/2018 | Kong | H01R 13/6594 |
| 9,905,946 | B2 * | 2/2018 | Tsai | H01R 12/57 |
| 9,912,106 | B2 * | 3/2018 | Yao | H01R 13/6594 |
| 9,912,111 | B2 * | 3/2018 | Little | H01R 24/60 |
| 9,917,405 | B2 * | 3/2018 | Ju | H01R 13/6585 |
| 9,923,286 | B2 * | 3/2018 | Cheng | H01R 9/032 |
| 9,923,310 | B2 * | 3/2018 | Kao | H01R 13/6596 |
| 9,923,317 | B2 * | 3/2018 | Yao | H01R 24/62 |
| 9,954,319 | B2 * | 4/2018 | Zhao | H01R 13/6591 |
| 10,027,066 | B2 * | 7/2018 | Zhong | H01R 13/6597 |
| 10,096,936 | B2 * | 10/2018 | Ju | H01R 13/6275 |
| 10,103,492 | B2 * | 10/2018 | Ju | H01R 13/04 |
| 2015/0295362 | A1 * | 10/2015 | Tziviskos | H01R 13/6581 439/607.01 |
| 2016/0020569 | A1 * | 1/2016 | Ju | H01R 24/78 439/607.01 |
| 2016/0087378 | A1 * | 3/2016 | Chen | H01R 13/6597 439/607.34 |
| 2016/0294121 | A1 * | 10/2016 | Daughtry, Jr. | H01R 13/405 |
| 2016/0380389 | A1 * | 12/2016 | Ju | H01R 13/6585 439/607.05 |
| 2017/0279234 | A1 * | 9/2017 | Tsai | H01R 24/60 |
| 2017/0294746 | A1 * | 10/2017 | Fang | H01R 13/6597 |
| 2017/0302013 | A1 * | 10/2017 | Ju | H01R 24/78 |
| 2017/0310058 | A1 * | 10/2017 | Ju | H01R 13/6585 |

* cited by examiner

100

100

200

ELECTRICAL CONNECTOR

CROSS-REFERENCE TO RELATED APPLICATION

This application is a continuation application of U.S. application Ser. No. 15/263,413, filed Sep. 13, 2016, which is a continuation application of U.S. application Ser. No. 14/626,709 know U.S. Pat. No. 9,917,405), filed Feb. 19, 2015, which itself claims priority to and the benefit of, pursuant to 35 U.S.C. § 119(e), U.S. provisional patent application Ser. No. 61/942,830, filed Feb. 21, 2014, and U.S. provisional patent application Ser. No. 62/024,728, filed Jul. 15, 2014. The entire contents of the above identified applications are incorporated herein by reference.

Some references, if any, which may include patents, patent applications and various publications, may be cited and discussed in the description of this invention. The citation and/or discussion of such references, if any, is provided merely to clarify the description of the present invention and is not an admission that any such reference is "prior art" to the invention described herein. All references listed, cited and/or discussed in this specification are incorporated herein by reference in their entireties and to the same extent as if each reference was individually incorporated by reference.

FIELD OF THE INVENTION

The present invention relates to an electrical connector, and more particularly to an electrical connector having a good shielding effect.

BACKGROUND OF THE INVENTION

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Chinese Patent CN201320378153.0 discloses, in paragraph [0008] of the specification, an electrical connector, which includes an insulation body, a first terminal group retained to the insulation body and a shielding member. The insulation body includes a base and a tongue extending forward. The tongue has a first surface and a second surface disposed opposite to each other. The first terminal group is exposed to the first surface, and the shielding member is disposed at the tongue and located between the first surface and the second surface. The first terminal group includes a grounding terminal. The grounding terminal is provided with a contact portion protruding towards the shielding member and contacting the shielding member. Paragraph [0020] discloses that the shielding member is integrally formed at a mating plate, the first terminal group and the second terminal group are oppositely assembled to the mating plate and then assembled forward to an assembly frame along with the mating plate, forming the insulation body. However, when the electrical connector of such a structure is used for transmitting high-speed signals, electromagnetic radiation produced by the first terminal group and the second terminal group is easy to leak backward, resulting in that crosstalk is produced during signal transmission at tails of the first terminal group and the second terminal group, which affects signal transmission quality of the electrical connector. In addition, terminals of such an electrical connector are simultaneously assembled to the first surface and the second surface, and as there are more terminals and the tongue is smaller, operations are inconvenient, which easily results in that the terminals are not mounted firmly and tilt upward, damaging the whole electrical connector.

Therefore, a heretofore unaddressed need exists in the art to address the aforementioned deficiencies and inadequacies.

SUMMARY OF THE INVENTION

In one aspect, the present invention relates to an electrical connector of which upper and lower grounding plates can cover a base portion of an insulation body to increase coverage of an inner metal shell and achieve a good shielding effect.

In certain embodiments, an electrical connector includes an insulation body, multiple terminals, an inner metal shell, and an outer metal shell. The insulation body has a base and a tongue located in a front end of the base. The multiple terminals are fixedly arranged in the base in upper and lower rows. Each of the upper row of terminals has a contact portion exposed to an upper surface, and each of the lower row of terminals has a contact portion exposed to a lower surface of the tongue. The inner metal shell has at least one covering portion disposed on the upper surface of the tongue, and at least one extending portion extending from the covering portion to the base, and the extending portion covers the base. The outer metal shell wraps the inner metal shell externally.

In one embodiment, the extending portion has at least one contacting arm, and the contacting arm urges against an inner wall of the outer metal shell.

In one embodiment, the end of the contacting arm bends downward to form a positioning portion, the base is provided with a concave slot corresponding to the positioning portion, and the positioning portion is received in the concave slot.

In one embodiment, a first receiving space is depressed from the base, and the extending portion is accommodated in the first receiving space.

In one embodiment, the inner metal shell further has a connection portion for vertically connecting the covering portion and the extending portion.

In one embodiment, the inner metal shell includes an upper grounding plate and a lower grounding plate, the upper grounding plate covers the upper surface of the tongue, and the lower grounding plate adjoins the lower surface of the tongue.

In one embodiment, each of two sides of the tongue is provided with a reserving slot, each of two side walls of the upper grounding plate is provided with a mating portion, each of two side walls of the lower grounding plate is provided with a fixing portion corresponding to the mating portion, and the mating portions and the fixing portions are accommodated in the reserving slot in a mutually mating manner to enable the inner metal shell to wrap a rear end of the tongue.

In one embodiment, the lower grounding plate has a stopping portion, and the stopping portion adjoins a lower surface of the base.

In one embodiment, the upper row of terminals and the lower row of terminals respectively include at least two grounding terminals. The grounding terminals are located at edges of the tongue and are each provided with a protruding portion in a front end thereof. The protruding portions partially protrude beyond the edges of the tongue.

In one embodiment, the upper row terminal and the lower row terminal are symmetrically arranged on the tongue, each terminal in the upper row terminal has a first rear portion disposed in the base, each terminal in the lower row terminal has a second rear portion disposed in the base, and the first rear portion and the second rear portion are arranged in two rows.

In one embodiment, the electrical connector further includes a middle grounding plate. The middle grounding plate includes a flat plate portion retained in the tongue and located between the upper row terminal and the lower row terminal, and a vertical portion extending downward from a rear end of the flat plate portion, and the vertical portion is located between the first rear portion and the second rear portion.

In one embodiment, a snap-fit slot depressed inward is formed on each of the two sides of the tongue, and the flat plate portion is partially exposed to the snap-fit slot.

In one embodiment, the tongue is assembled on the base, a lower surface of the base has a second receiving space, the insulation body further includes a plastic block, and the plastic block is accommodated in the second receiving space and assembled on the base.

In another aspect, the present invention relates to an electrical connector including an insulation body, multiple terminals arranged in an upper row and a lower row, and a middle grounding plate. The insulation body has a base and a tongue located in a front end of the base. The multiple terminals in the upper row and the multiple terminals in the lower row are arranged on upper and lower surfaces of the tongue, respectively. The middle grounding plate is disposed in the base, extending to the tongue, located between the upper and lower rows of terminals, and provided with at least one first hole. An edge of each of two lateral sides of the middle grounding plate is inwardly depressed to form a first groove. The first hole is located between the two first grooves, and the insulation body has a first insulation portion and a second insulation portion, the first insulation portion protrudes into the first hole and the second insulation portion protrudes into the first grooves.

In one embodiment, the edge of each of the two lateral sides of the middle grounding plate is inwardly depressed to form a latch slot, and the latch slots are located closer to a front end of the middle grounding plate than the first grooves are.

In one embodiment, each of the first grooves is adjacent to a corresponding latch slot on the same lateral side, and each of the first grooves is connected with the corresponding latch slot on the same lateral side of the middle grounding plate.

In one embodiment, the first grooves are closer to a centerline of the middle grounding plate from the front end to the rear end of the middle grounding plate than the latch slots are.

In one embodiment, each of the first grooves is provided with a first inner edge, a second inner edge and a third inner edge, the first inner edge is closer to a front side of the tongue than the second inner edge is, the third inner edge is connected between the first inner edge and the second inner edge, and each of the first inner edges of the first grooves is connected with a latch slot on the same lateral side of the middle grounding plate.

In one embodiment, each of the first inner edge and the second inner edge is connected with the third inner edge through an arc-shaped connection portion.

In one embodiment, a length of a projection of the first inner edge along an axis between front and rear ends of the middle grounding plate is less than a length of a projection of the second inner edge along the axis.

In one embodiment, a distance between an inner sidewall of the first hole and a front end of the middle grounding plate is greater than a distance between the first inner edge and the front end of the middle grounding plate, and is smaller than a distance between the second inner edge and the front end of the middle grounding plate.

In one embodiment, the first hole overlaps a centerline of the middle grounding plate along an axis between front and rear ends of the middle grounding plate, and is bilaterally symmetric relative to the centerline of the middle grounding plate.

In one embodiment, the middle grounding plate and the tongue are insert-molded.

In one embodiment, the middle grounding plate has a body portion disposed in the insulation body, the body portion has a first section located in the tongue and extends from the first section to form a second section located in the base, the first hole is disposed in the first section, and each of the first grooves is disposed in the first section and the second section.

In one embodiment, the middle grounding plate is further provided with multiple second holes that surround the first hole.

In one embodiment, the insulation body has a third insulation portion, the third insulation portion protrudes into the second holes.

In another aspect, the present invention relates to an electrical connector including an insulation body, multiple terminals arranged in an upper row and a lower row, and a middle grounding plate. The insulation body has a base and a tongue located in a front end of the base. The multiple terminals in the upper row and the multiple terminals in the lower row are arranged on upper and lower surfaces of the tongue, respectively. The middle grounding plate is disposed in the base, extending to the tongue, located between the upper and lower rows of terminals, and provided with at least one first hole. An edge of each of two lateral sides of the middle grounding plate is inwardly depressed to form a first groove. The insulation body has a first insulation portion and a second insulation portion, the first insulation portion protrudes into the first hole, the second insulation portion protrudes into the first grooves, the first groove is provided with a first inner edge, a third inner edge and a second inner edge, the first inner edge is connected with the third inner edge, the third inner edge is connected with the second inner edge, and a length of a projection of the first inner edge along an axis between front and rear ends of the middle grounding plate is less than a length of a projection of the second inner edge along the axis.

In one embodiment, the first inner edge is closer to a front side of the tongue than the second inner edge is, the third inner edge is connected between the first inner edge and the second inner edge, and the second inner edge is perpendicular to the third inner edge.

In one embodiment, the first inner edge is located in the tongue, and the second inner edge is located in the base.

In one embodiment, the first hole has two fourth inner edges parallel to each other, and the third inner edge is parallel to the fourth inner edges.

In one embodiment, two first holes are bilaterally symmetric relative to a centerline of the middle grounding plate along the axis between front and rear ends of the middle grounding plate.

In one embodiment, the middle grounding plate is further provided with multiple second holes which are in direct front of the first hole.

In one embodiment, the tongue has a third insulation portion, and the third insulation portion protrudes into the second holes.

The present invention has the following beneficial effects: in the electrical connector, the inner metal shell has the extending portion covering an upper surface of the base, which increases coverage of the inner metal shell, effectively improves signal transmission quality at the end of the terminals and improves signal transmission stability of the whole electrical connector. The insulation body is assembled by the base, the plastic block and the tongue, which simplifies the manufacturing process of the insulation body and reduces the manufacturing cost of the electrical connector. Moreover, the middle grounding plate is provided with a first hole. An edge of each of two lateral sides of the middle grounding plate is inwardly depressed to form a first groove. The first hole is located between the two first grooves, the insulation body has a first insulation portion and a second insulation portion, the first insulation portion protrudes into the first hole, and the second insulation portion protrudes into the first grooves. The first insulation portion and the second insulation portion can better secure the middle grounding plate, so that in a process that the electrical connector is plugged in a mating connector, the middle grounding plate can be stably retained between the upper and lower rows of terminals without displacement, thereby improving high-frequency performance of the electrical connector.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment.

DETAILED DESCRIPTION OF THE INVENTION

Figure 1:
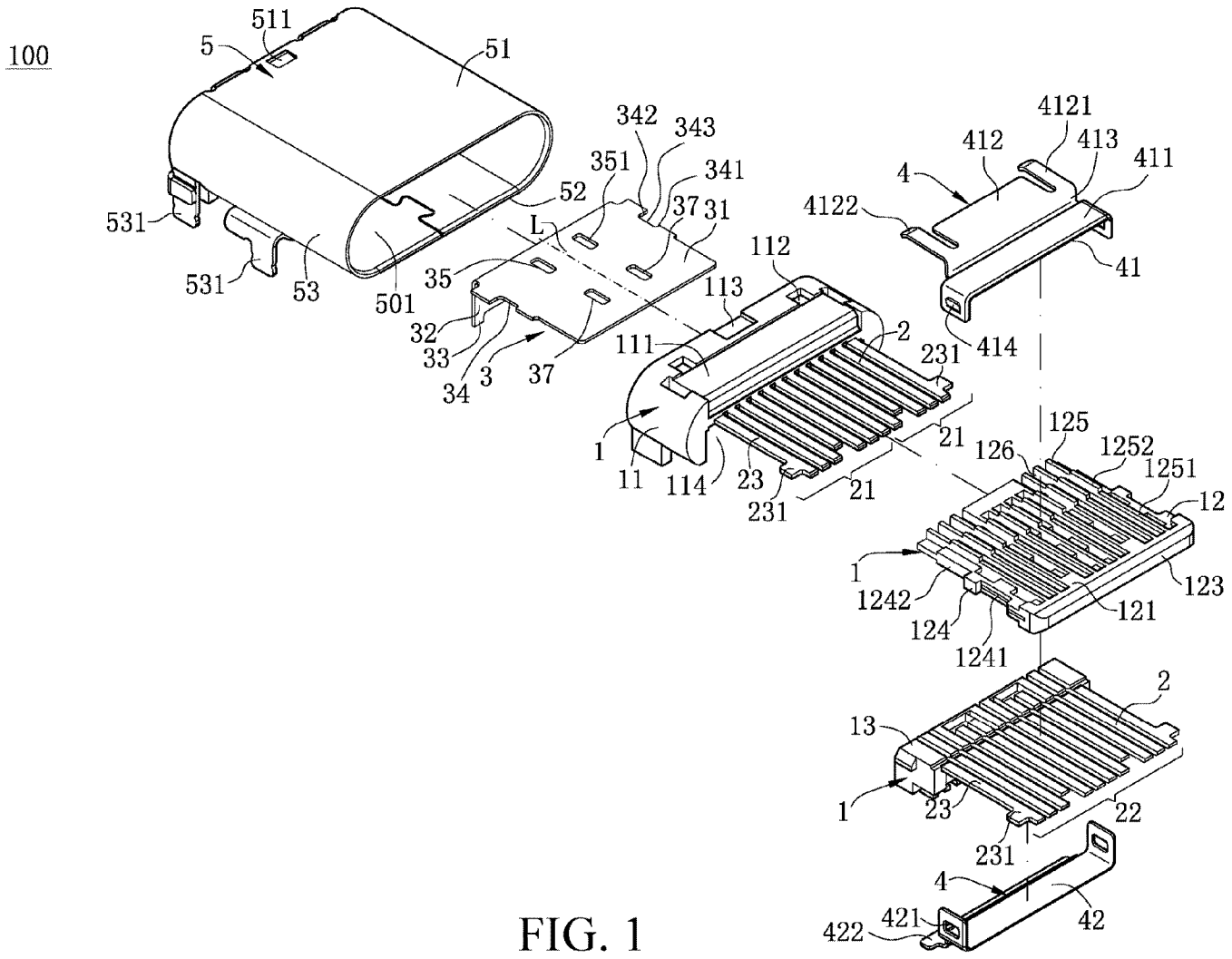
FIG. 1 is a schematic three-dimensional exploded view of an electrical connector according to a first embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

The terms used in this specification generally have their ordinary meanings in the art, within the context of the disclosure, and in the specific context where each term is used. Certain terms that are used to describe the disclosure are discussed below, or elsewhere in the specification, to provide additional guidance to the practitioner regarding the description of the disclosure. For convenience, certain terms may be highlighted, for example using italics and/or quotation marks. The use of highlighting has no influence on the scope and meaning of a term; the scope and meaning of a term is the same, in the same context, whether or not it is highlighted. It will be appreciated that same thing can be said in more than one way. Consequently, alternative language and synonyms may be used for any one or more of the terms discussed herein, nor is any special significance to be placed upon whether or not a term is elaborated or discussed herein. Synonyms for certain terms are provided. A recital of one or more synonyms does not exclude the use of other synonyms. The use of examples anywhere in this specification including examples of any terms discussed herein is illustrative only, and in no way limits the scope and meaning of the disclosure or of any exemplified term. Likewise, the disclosure is not limited to various embodiments given in this specification.

Unless otherwise defined, all technical and scientific terms used herein have the same meaning as commonly understood by one of ordinary skill in the art to which this disclosure pertains. In the case of conflict, the present document, including definitions will control.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, "plurality" and/or "multiple" means two or more.

As used herein, the terms "comprising", "including", "carrying", "having", "containing", "involving", and the like are to be understood to be open-ended, i.e., to mean including but not limited to.

Figure 3:
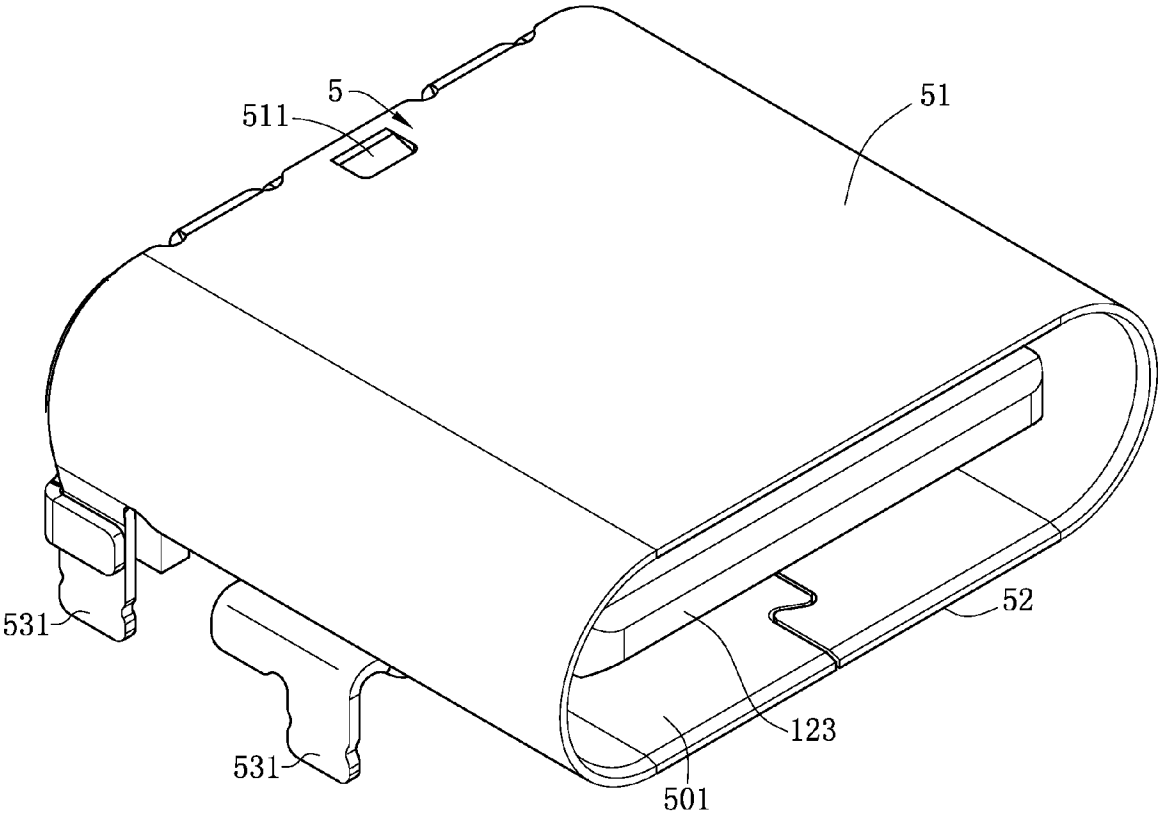
FIG. 3 is a schematic three-dimensional assembly view of an electrical connector according to certain embodiments of the present invention.
Figure 6:
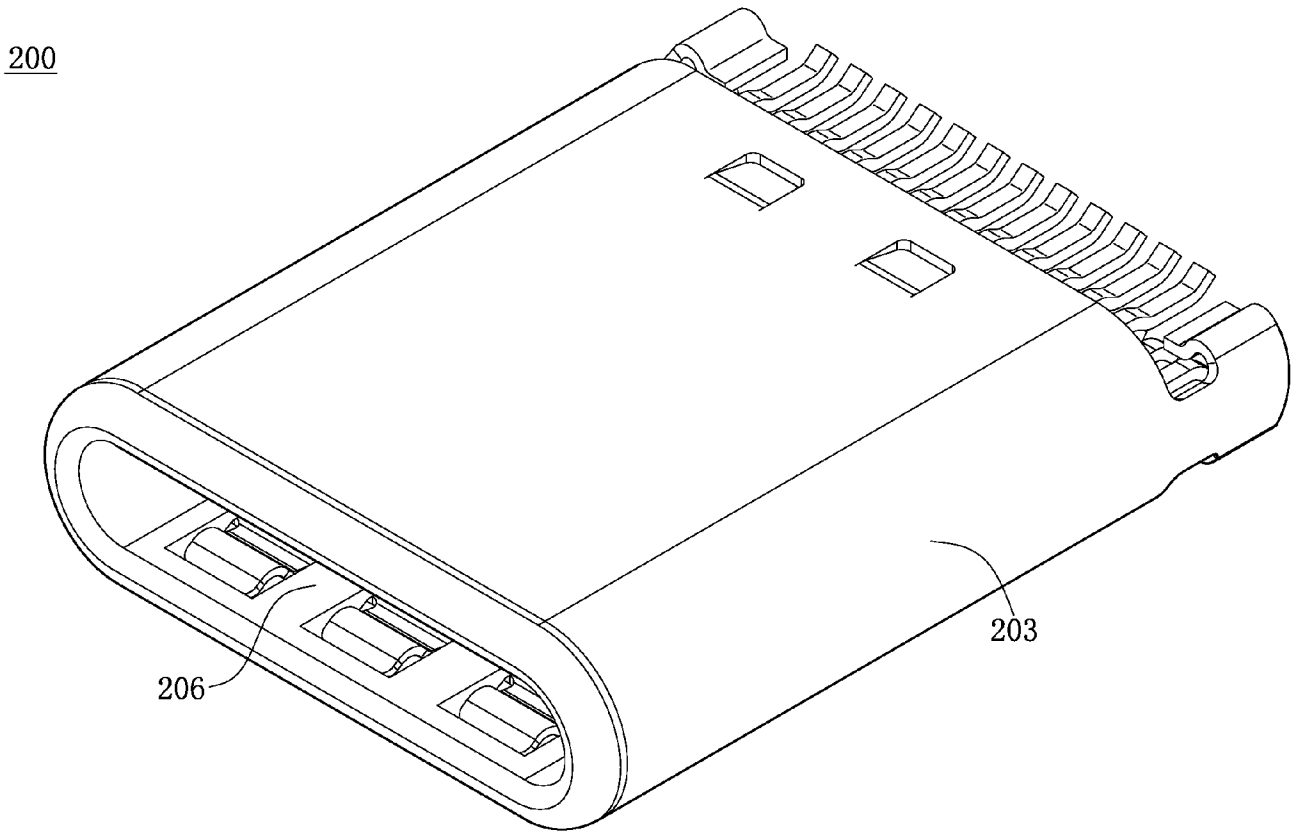
FIG. 6 is a schematic three-dimensional assembly view of a mating connector according to certain embodiments of the present invention.

As shown in FIGS. 3 and 6, an electrical connector 100 according to certain embodiments of the present invention is an electrical connector socket that supports high-speed data transmission, and a mating connector 200 is an electrical connector plug that supports high-speed data transmission.

Figure 2:
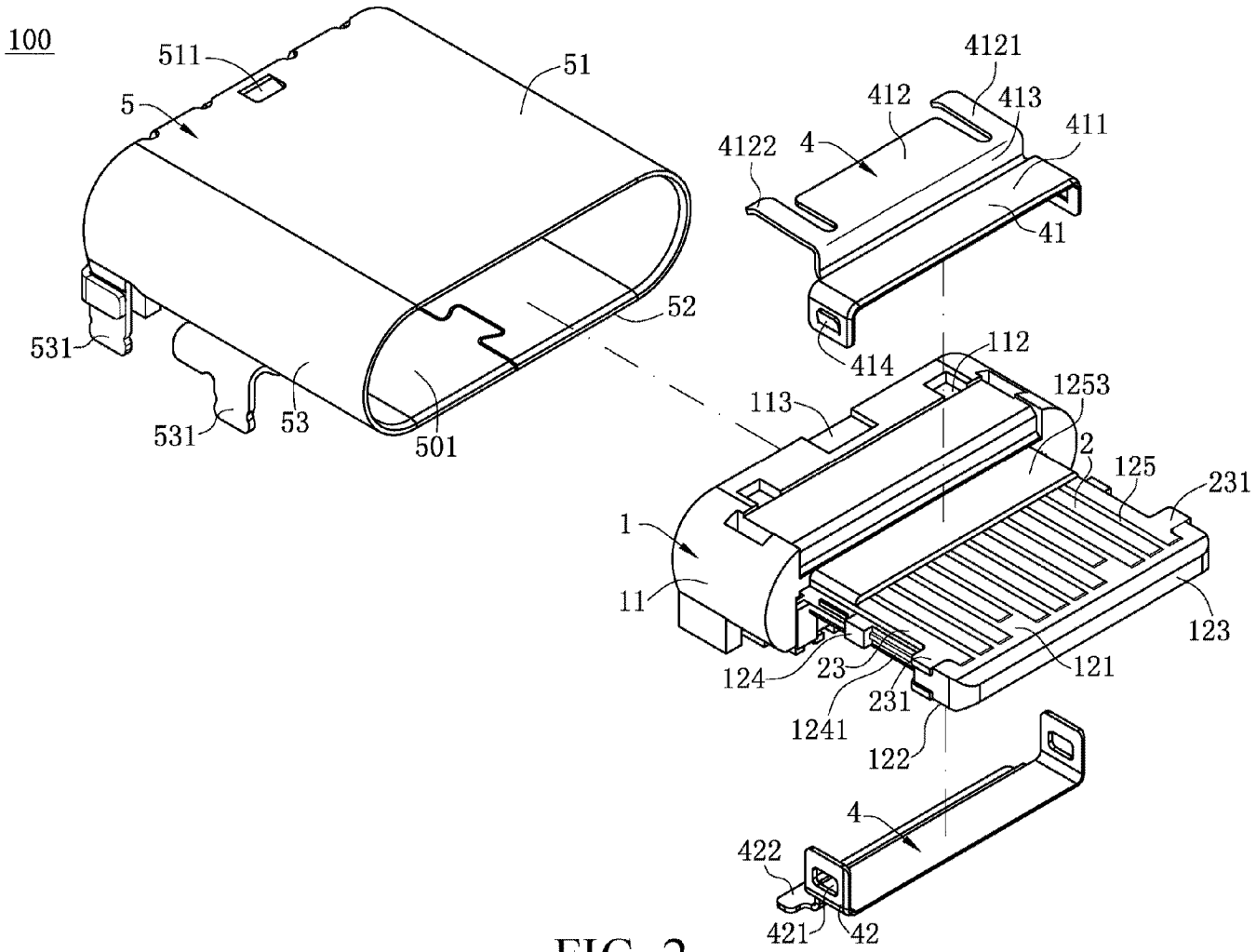
FIG. 2 is a schematic partial three-dimensional exploded view of an electrical connector according to certain embodiments of the present invention.

As shown in FIGS. 1-3, the electrical connector 100 includes an insulation body 1, multiple terminals 2 fixed disposed at the insulation body 1; a middle grounding plate 3 fixed disposed at the insulation body 1; an inner metal shell 4 covering and fixed onto the insulation body 1; and an outer metal shell 5 framed outside the insulation body 1 and the inner metal shell 4, to form an insertion space 501. The outer metal shell 5 has multiple soldering pins 531, and the soldering pins 531 can be correspondingly soldered onto a grounding circuit of a circuit board (not shown).

Figure 7A:
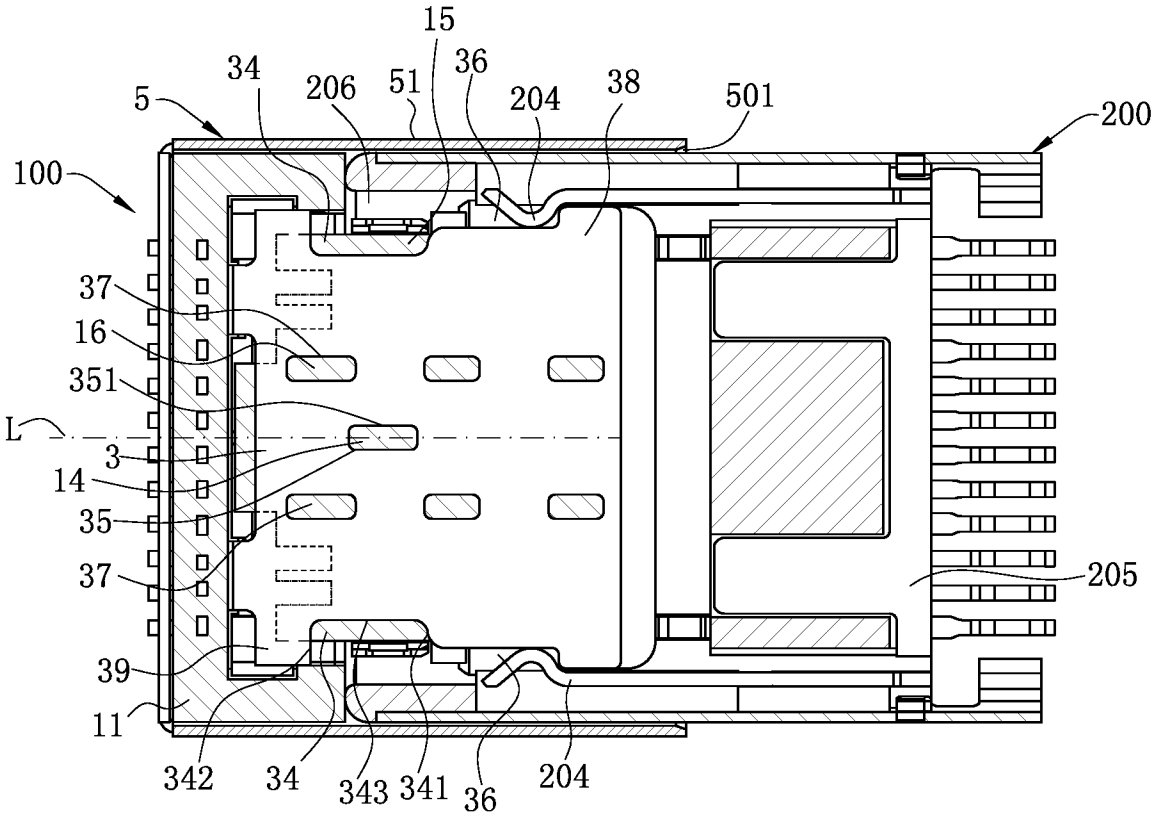
FIG. 7A is a sectional view when an electrical connector according to a second embodiment of the present invention mates a mating connector.
Figure 7B:
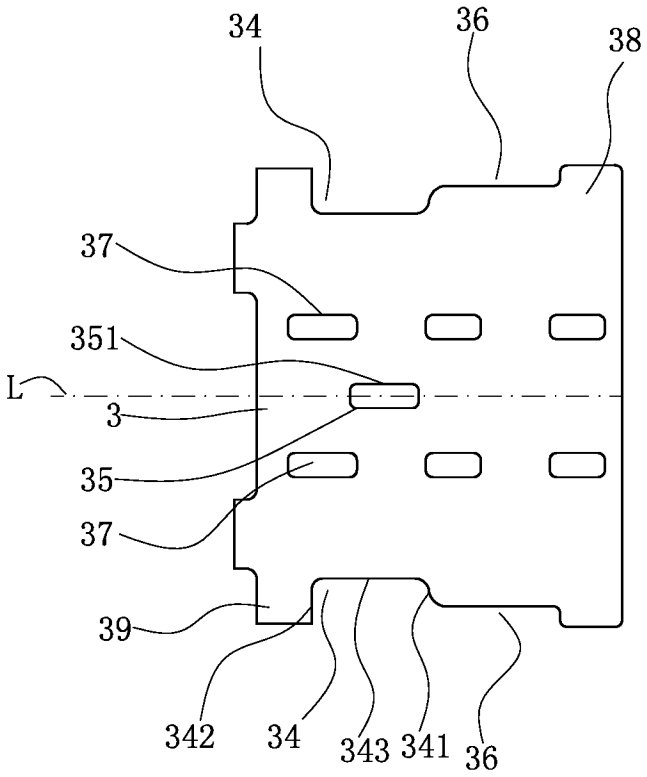
FIG. 7B is a schematic view of the middle grounding plate in FIG. 7A.

It should be noted that the structure of the components of the electrical connector 100 may be varied in different embodiments of the present application. For example, FIG. 1 shows an electrical connector 100 according to a first embodiment of the present invention, in which the the middle grounding plate 3 has a certain structure. In comparison, FIGS. 7A and 7B shows an electrical connector 100 according to a second embodiment of the present invention, which is different from the first embodiment as shown in FIG. 1 in that the structure of the middle grounding plate 3 is different. Other parts of the components or structures of the electrical connector 100 according to each of the first and second embodiments are substantially identical. Details of the structures of the electrical connector will be described hereinafter.

Figure 5:
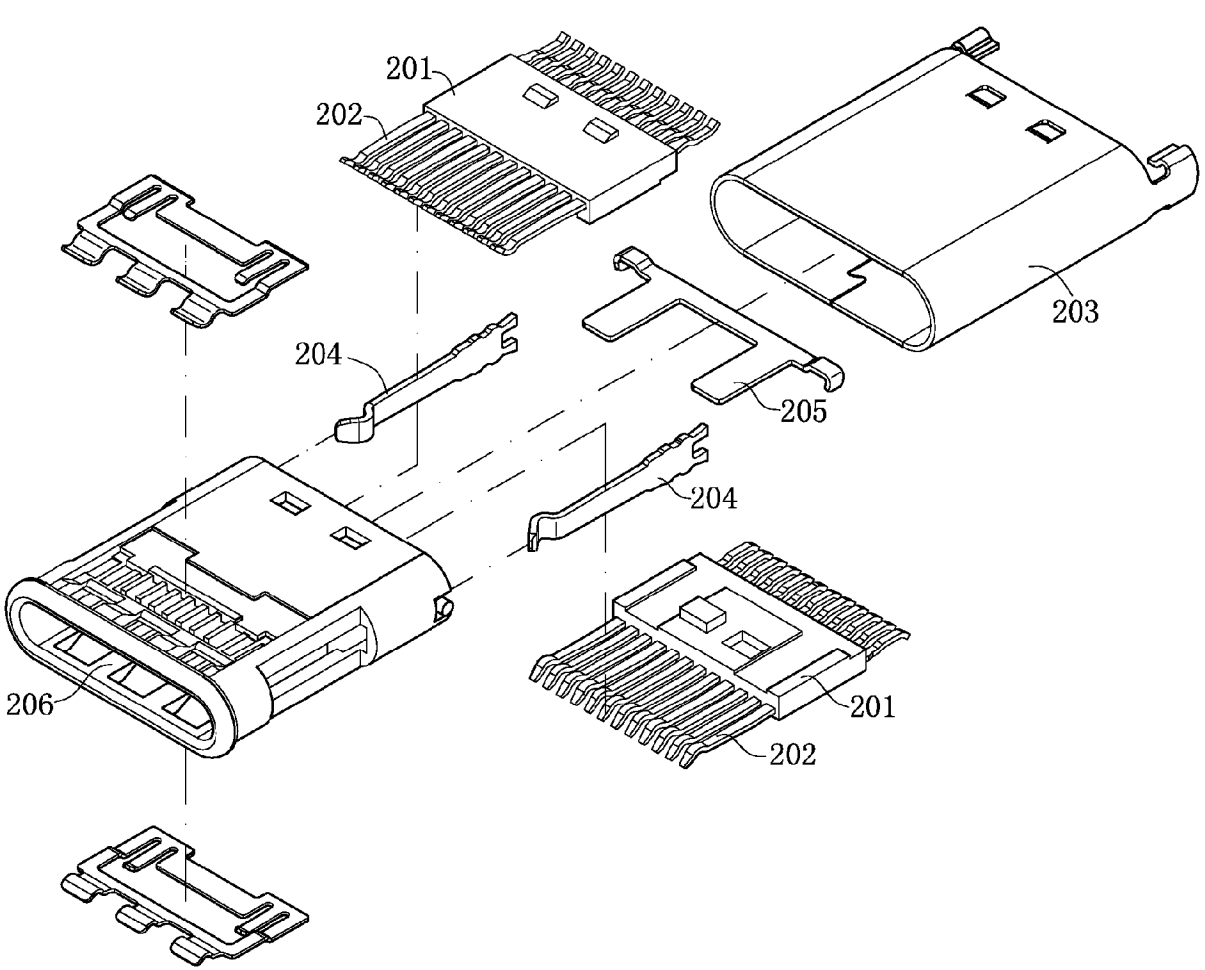
FIG. 5 is a schematic three-dimensional exploded view of a mating connector according to certain embodiments of the present invention.

As shown in FIGS. 5-7, the mating connector 200 includes a plastic body 201, multiple contact terminals 202 fixed to the plastic body 201, a shielding casing 203 wraps the plastic body 201, a middle shielding sheet 205 fixedly disposed in the plastic body 201, two retaining elastic sheets 204 respectively fixedly disposed to two sides of the plastic body 201, and a mating cavity 206 disposed in a front end of the plastic body 201. When the mating connector 200 is inserted into the insertion space 501 of the electrical connector 100, in addition to that the contact terminals 202 are connected with the corresponding multiple terminals 2, the retaining elastic sheets 204 may contact the middle grounding plate 3 to form a first grounding shielding structure, thus preventing electromagnetic radiation from passing through the insulation body 1 to leak backward to interfere signal transmission of the terminals 2. Moreover, the outer metal shell 5 and the shielding casing 203 form a second grounding shielding structure, which can thus effectively form a wholly surrounded shielding structure.

As shown in FIGS. 1 and 2, in the electrical connector 100 according to the first embodiment of the present invention, the insulation body 1 includes a base 11 and a tongue 12 assembled to a front end of the base 11, and a plastic block 13 superimposed below the base 11. The middle grounding plate 3 and the tongue 12 are insert-molded. In other embodiments, the base 11, the tongue 12 and the plastic block 13 may be integrally formed or formed in any other manners, and the middle grounding plate 3 may also be insert-molded with the insulation body 1, the base 11, or the plastic block 13, which is not limited herein.

Figure 4:
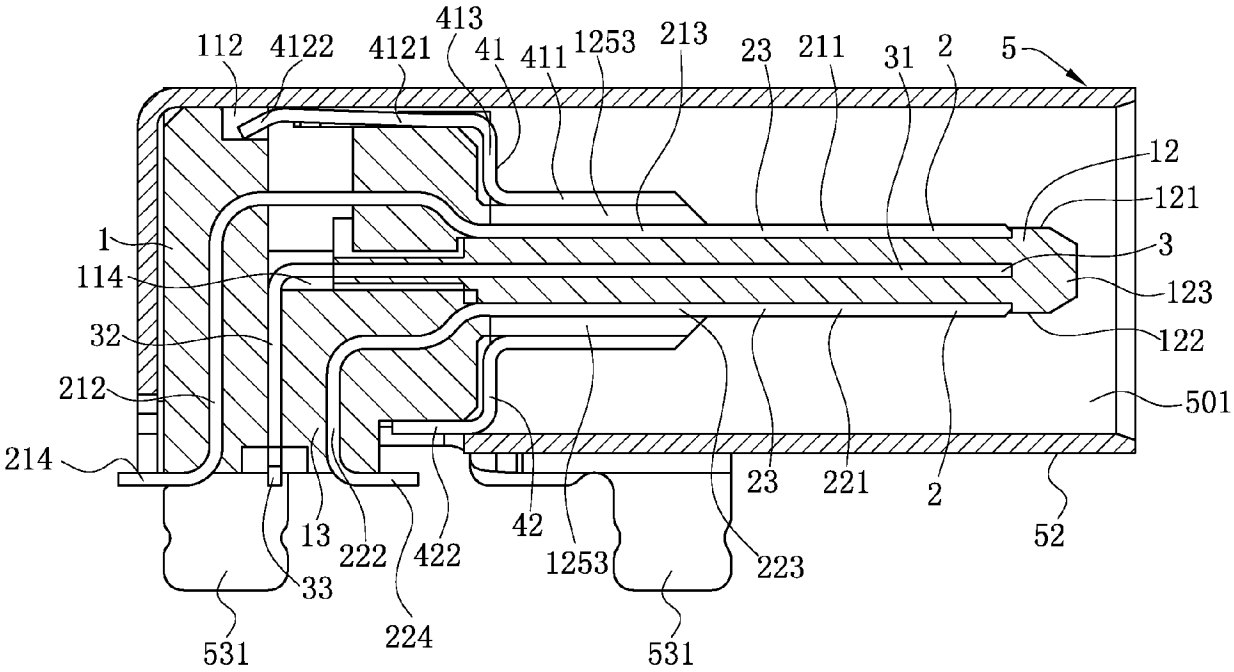
FIG. 4 is a sectional view of the electrical connector according to certain embodiments of the present invention.

As shown in FIGS. 2 and 4, the multiple terminals 2 include a group of upper row terminals 21 and a group of lower row terminals 22. The upper row terminals 21 are integrally formed with the base 11. Each of the upper row terminals 21 includes a first mating portion 211, a first rear portion 212 and a first connection portion 213 connected between the first mating portion 211 and the first rear portion 212. The first mating portion 211 may extend backward to form the first connection portion 213, the first connection portion 213 may bend downward and extend to form the first rear portion 212 that is vertical, and the first rear portion 212 may bend backward and extend to form a first soldering portion 214 that is horizontal. The lower row terminals 22 are integrally formed with the plastic block 13. Each of the lower row terminals 22 includes a second mating portion 221, a second rear portion 222 and a second connection portion 223 connected between the second mating portion 221 and the second rear portion 222. The second mating portion 221 may extend backward to form the second connection portion 223, the second connection portion 223 may bend downward and extend to form the second rear portion 222 that is vertical, and the second rear portion 222 may bend forward and extend to form a second soldering portion 224 that is horizontal. The middle grounding plate 3 is insert-molded and fixed into the tongue 12. When the base 11, the tongue 12 and the plastic block 13 are assembled together, an upper surface of the rear section 1252 forms a flat plate portion 1253 through hot melting to retain the first connection portion 213, and a lower surface of the rear section 1252 forms the flat plate portion 1253 through hot melting to retain the second connection portion 223, preventing the terminals 2 from tilting upward in the terminal receiving slot 126. The first mating portion 211 is correspondingly received in the terminal receiving slot 126 and exposed to the upper surface 121. The second mating portion 221 is correspondingly received in the terminal receiving slot 126 and exposed to the lower surface 122. The first rear portions 212 and the second rear portions 222 are arranged in two rows. The upper row terminal 21 and the lower row terminal 22 further respectively include two grounding terminals 23. The grounding terminals 23 are located at edges of the tongue 12 and each has a protruding portion 231 in front ends thereof, and the protruding portions 231 partially protrude beyond the edges of the tongue 12, avoiding worn out of the tongue 12 during mating of the electrical connector 100. The first mating portions 211 and the second mating portions 221 are symmetrically disposed at 180 degrees in the inserting space 501, thus enabling the mating connector 200 to be inserted into the electrical connector 100 in dual orientation.

As shown in FIGS. 4, 7A and 7B, the middle grounding plate 3 includes a body portion 31, a vertical portion 32, and multiple grounding pins 33. The body portion 31 is retained into the tongue 12 and located between the upper row terminal 21 and the lower row terminal 22, separates the upper row terminal 21 and the lower row terminal 22, and shields signal interference between the upper row terminal 21 and the lower row terminal 22. The body portion 31 is further partially exposed to the snap-fit slot 1241 and connected with the retaining elastic sheets 204. The vertical portion 32 extends downward from a rear end of the body portion 31, is located between the first rear portions 212 and the second rear portions 222, separates the first rear portion 212 and the second rear portion 222, and shields signal interference between the first rear portions 212 and the second rear portions 222. The multiple grounding pins 33 extend downward from the vertical portion 32, used for being soldered onto a grounding circuit of the circuit board (not shown).

As shown in FIGS. 7A and 7B, the middle grounding plate 3 is in a shape of a plate, an edge of each of two lateral sides of a front end of the body portion 31 is respectively inwardly depressed to form a latch slot 36. The latch slots 36 are used for receiving a retaining elastic piece 204 of the mating connector 200 and abutting against the retaining elastic piece 204, so that the middle grounding plate 3 connects with the retaining elastic piece 204 of the mating connector 200. The two latch slots 36 are bilaterally symmetric relative to a centerline L of the middle grounding plate 3 along an axis between front and rear ends of the middle grounding plate.

An edge of each of two lateral sides of a rear end of the body portion 31 is inwardly depressed to form a first groove 34. The two first grooves 34 are bilaterally symmetric relative to the centerline L of the middle grounding plate 3. The first grooves 34 are adjacent to the latch slots 36, the first grooves 34 are connected with the latch slots 36, the latch slots 36 are located closer to a front end of the middle grounding plate 3 than the first grooves 34 are, and the first grooves 34 are closer to the centerline L of the middle grounding plate 3 than the latch slots 36 on the same side.

As shown in FIG. 7A and FIG. 7B, the middle grounding plate 3 is further provided with a first hole 35. In this embodiment, the first hole 35 is a through hole and located between the two first grooves 34. The two first grooves 34 and the first hole 35 are arranged into one row along a left-right direction. The two first grooves 34 are bilaterally symmetric relative to the first hole 35. The first hole 35 overlaps the centerline L of the middle grounding plate 3 and is bilaterally symmetric relative to the centerline L of the middle grounding plate 3. As shown in FIG. 1, in the first embodiment or other embodiments, there may be multiple first holes 35, the first holes 35 are located between the two first grooves 34, and the multiple first holes 35 are bilaterally symmetric relative to the centerline L of the middle grounding plate 3, which is not limited herein.

As shown in FIGS. 7A and 7B, each of the first grooves 34 has a first inner edge 341, a second inner edge 342 and a third inner edge 343, the first inner edge 341 is closer to a front side of the tongue 12 than the second inner edge 342. The third inner edge 343 is connected between the first inner edge 341 and the second inner edge 342. Each of the first inner edge 341 and the second inner edge 342 is connected to the third inner edge 343 through an arc-shaped connection portion. The body portion 31 of the middle grounding plate 3 is disposed in the insulation body 1. The body portion 31 has a first section 38 located in the tongue 12 and extends backward from the first section 38 to form a second section 39 located in the base 11. The first hole 35 is disposed in the first section 38, and each of the first grooves 34 is disposed in the first section 38 and the second section 39. The first inner edge 341 is connected with the latch slot 36, and a length of a projection of the first inner edge 341 along an axis between front and rear ends of the middle grounding plate is less than a length of a projection of the second inner edge 342 along the axis. The length of the second inner edge 342 is less than the length of the third inner edge 343. That is, the first grooves 34 are provided with sequentially-connecting three inner edges having different lengths. Two fourth inner edges 351 parallel to each other are formed on left and right sides of the first hole 35, and the third inner edge 343 is parallel to the fourth inner edges 351. A distance between an inner sidewall of the first hole 35 and a front end of the middle grounding plate 3 is greater than a distance between the first inner edge 341 of the first groove 34 and the front end of the middle grounding plate 3, and is smaller than a distance between the second inner edge 342 of the first groove 34 and the front end of the middle grounding plate 3. In other embodiments, it is also possible that the distance between the inner sidewall of the first hole 35 and the front end of the middle grounding plate 3 is limited to be greater than the distance between the first inner edge 341 of the first groove 34 and the front end of the middle grounding plate 3 only and without other limitations. The insulation body 1 has a first insulation portion 14 and a second insulation portion 15, the first insulation portion 14 protrudes into the first hole 35, and the second insulation portion 15 protrudes into the first grooves 34. The middle grounding plate 3 is further provided with multiple second holes 37 which are symmetrically distributed on two sides of the centerline L of the middle grounding plate 3. The multiple second holes 37 surround the first hole 35. The insulation body 1 has a third insulation portion 16, the third insulation portion 16 protrudes into the second holes 37. In other embodiments, as shown in FIG. 1, the second holes 37 are in direct front of the first hole 35. The tongue 12 has the third insulation portion 16, and the third insulation portion 16 protrudes into the second holes 37.

As shown in FIGS. 1, 3 and 4, the outer metal shell 5 includes a top wall 51, a bottom wall 52 and two side walls 53 connecting the top wall 51 and the bottom wall 52. The top wall 51 pierces downward corresponding to the position of the limiting slot 113 to provide an urging portion 511 urging against an inner wall of the limiting slot 113, preventing the outer metal shell 5 from moving forward. In other embodiments, the urging portion 511 may be formed in any other manners, which is not limited herein. A middle portion of each of the side walls 53 extends downward to form a soldering pin 531, a rear end of each of the side walls 53 extends downward to form a soldering pin 531, and the soldering pins 531 are used for being soldered to the circuit board (not shown).

As shown in FIGS. 1 and 4, the inner metal shell 4 includes an upper grounding plate 41 and a lower grounding plate 42. The upper grounding plate 41 includes a covering portion 411, an extending portion 412 and a connection portion 413 vertically connecting the covering portion 411 and the extending portion 412. The covering portion 411 covers the flat plate portion 1253. The extending portion 412 covers an upper surface of the base 11 and is accommodated in the first receiving space 111. Each of two sides of the extending portion 412 has a contacting arm 4121 extending backward and upward. The contacting arms 4121 urges against an inner wall of the outer metal shell 5, to from an electrical connection, making the inner metal shell 4 grounded. The end of each contacting arm 4121 bends downward to form a positioning portion 4122, so that the contacting arm 4121 is in an arc shaped contact with the inner wall of the outer metal shell 5, to facilitate assembling of the outer metal shell 5 to the insulation body 1. The positioning portions 4122 are respectively received in the concave slots 112, preventing the inner metal shell 4 from sliding forward. Each of two side walls of the upper grounding plate 41 is further provided with a mating portion 414, and each of two side walls of the lower grounding plate 42 is provided with a fixing portion 421 corresponding to the mating portion 414. The mating portion 414 and the fixing portion 412 are accommodated in the reserving slots 1242 correspondingly in a mutually mating manner, such that the inner metal shell 4 wraps the insulation body 1. The lower grounding plate 42 further has a stopping portion 422. The stopping portion 422 adjoins a lower surface of the plastic block 13, to firmly assemble the plastic block 13 to the base 11. In other embodiments, the upper grounding plate 41 and the lower grounding plate 42 may be integrally formed, which is not limited herein.

Figure 8:
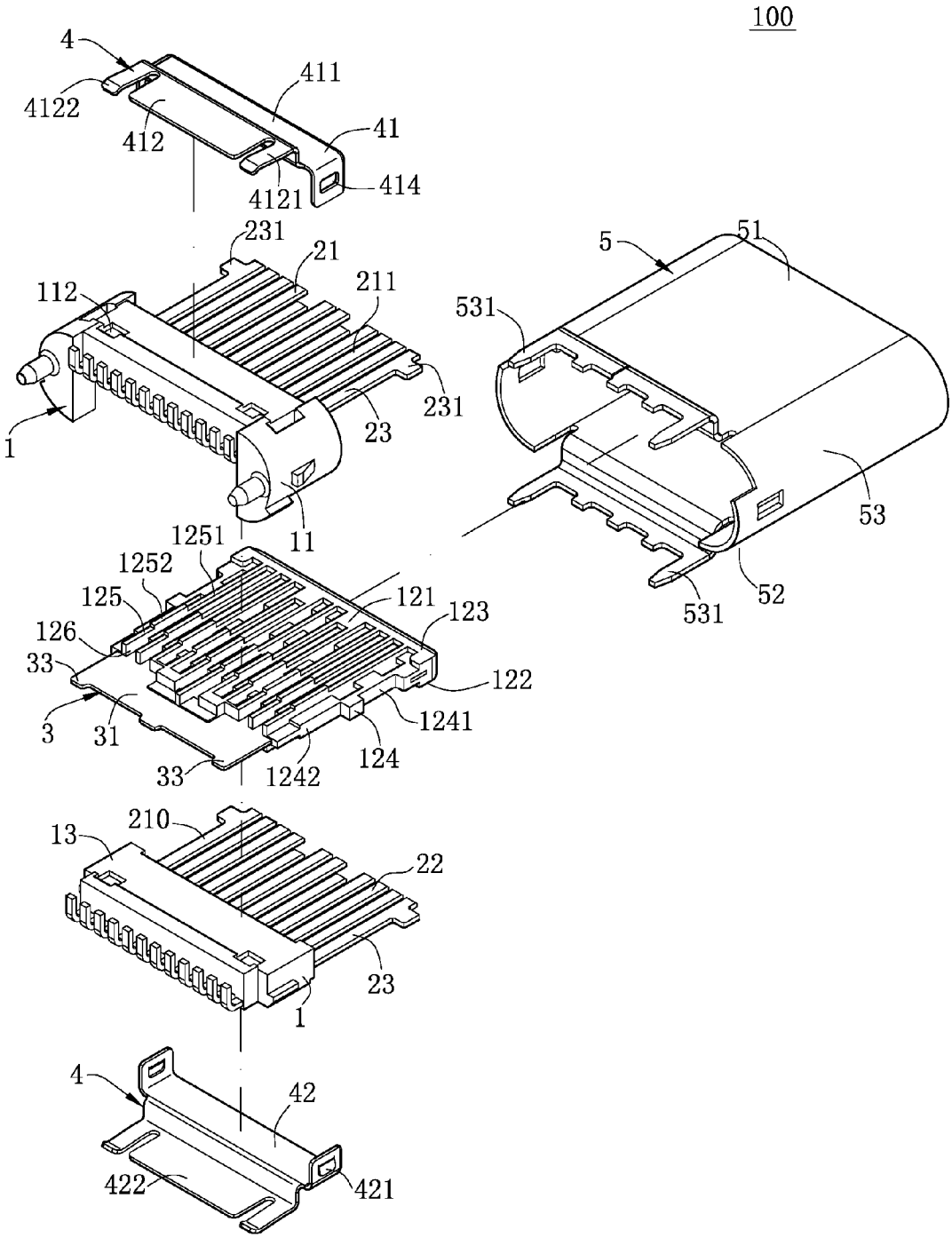
FIG. 8 is a schematic three-dimensional exploded view of an electrical connector according to a third embodiment of the present invention.

FIG. 8 shows an electrical connector 100 according to a third embodiment of the present invention. The third embodiment is different from the first embodiment in that the electrical connector in the third embodiment is a vertical electrical connector. In this embodiment, the middle grounding plate 3 is not provided with the vertical portion 32, the grounding pin 33 also extends in a direction directly from the body portion 31 to the circuit board (not shown), and the soldering pin 531 extends in a direction from the top wall 51 and the bottom wall 52 to the circuit board (not shown).

As shown in FIGS. 1 and 2, in the electrical connector 100, during assembly, firstly, the base 11 and the upper row terminals 21 are integrally formed, the plastic block 13 and the lower row terminals 21 are integrally formed, and the middle grounding plate 3 is integrally fixed into the tongue 12; secondly, the tongue 12 is inserted into the base 11 from front to rear, and the plastic block 13 is assembled to the base 11 from bottom to top; then, the rear section 1252 is correspondingly hot-melted to retain the terminals 2 onto the tongue 12, the upper grounding plate 41 covers the insulation body 1 downward, and the lower grouping sheet 42 covers the insulation body 1 upward; finally, the outer metal shell 5 is sleeved over the insulation body 1 and correspondingly soldered onto the circuit board (not shown).

As shown in FIGS. 7A and 7B, when the middle grounding plate 3 is insert-molded into the tongue 12, the insulation material forming the insulation body 1 flows into the first hole 35, the first groove 34 and the second hole 37, respectively forming the first insulation portion 14, the second insulation portion 15 and the third insulation portion 16. After cooling, the insulation body 1 wraps the middle grounding plate 3, specifically, the first groove 34 and the first hole 35 are respectively provided with the first insulation portion 14 and the second insulation portion 15 protruding in the insulation body 1, so that the middle grounding plate 3 can be stably retained in the insulation body 1, the middle grounding plate 3 is further firmly retained in the electrical connector 100, and a scenario of the middle grounding plate 3 being displaced and contact between the middle grounding plate 3 and the retaining elastic piece 204 of the mating connector 200 being not stable is avoided during the process of the electrical connector 100 being plugged in the mating connector 200. There is a good shielding effect for the upper row terminals and the lower row terminals, and high-frequency performance of the electrical connector 100 is improved. Connection portions through which the first inner edge 341, the second inner edge 342 and the third inner edge 343 of the first grooves 34 are connected are all arc-shaped, and connection portions through which inner sidewalls of the first hole 35 are connected to each other are also arc-shaped, which facilitates the insulation material forming the insulation body 1 to better fill in the first hole 35 and the first grooves 34. Thus, the first hole 35 and the first grooves 34 are filled with the insulation material of the insulation body 1, forming the first insulation portion 14 and the second insulation portion 15, so that the insulation body 1 can better retain the middle grounding plate 3.

The latch slot 36 of the middle grounding plate 3 is used for snapping the retaining elastic piece 204 of the mating connector 200. When the middle grounding plate 3 is insert-molded with the tongue 12, the insulation material of the insulation body 1 is to be filled in the first groove 34, while the insulation material of the insulation body 1 cannot flow into the latch slot 36, and thus the first groove 34 is closer to the centerline L of the middle grounding plate 3 than the latch slot 36 is, so as to facilitate the manufacturing process. The tongue 12 is narrower than the base 11, and the first groove 34 is set to be longer in the front-rear direction as much as possible, which helps the first groove 34 to accommodate more of the insulation material of the insulation body 1 and makes the first insulation portion 14 protruding in the insulation body 1 to better retain the middle grounding plate 3. Therefore, the first inner edge 341 of the first groove 34 is retained in the tongue 12, and the second inner edge 342 of the first groove 34 is retained in the base 11. The width of the base 11 is greater than the width of the tongue 12, the first inner edge 341 of the first groove 34 is connected with the snap-fit latch slot 36, the length of the projection of the first inner edge 341 of the first groove 34 along an axis between front and rear ends of the middle grounding plate is less than the length of the second inner edge 342 of the first groove 34 along the axis, the second inner edge 342 is longer, a contact area between the second inner edge 342 and the insulation material in the first groove 34, that is, the first insulation portion 14, is greater, thus increasing a retaining force of the insulation body 1 for the middle grounding plate 3, and forward movement of the middle grounding plate 3 can be blocked. The first holes 35 overlaps the centerline L of the middle grounding plate 3 and are bilaterally symmetric relative to the centerline L of the middle grounding plate 3, so that the first insulation portion 14 in the first holes 35 has a relatively balanced retaining force for the middle grounding plate 3, preventing the middle grounding plate 3 from displacement due to uneven force. The two first grooves 34 are also bilaterally symmetric relative to the centerline L of the middle grounding plate 3, so that the second insulation portion 15 in the first grooves 34 also have a relatively balanced retaining force for the middle grounding plate 3, preventing the middle grounding plate 3 from displacement due to uneven force. The multiple second holes 37 of the middle grounding plate 3 are bilaterally symmetric relative to the centerline L of the middle grounding plate 3, the third insulation portion 16 protruding in the second holes 37 can increase the retaining force of the insulation body 1 for the middle grounding plate 3, and the second holes 37 are evenly distributed on the middle grounding plate 3, so that the middle grounding plate 3 is evenly forced, ensuring uniform strength of respective parts of the middle grounding plate 3.

In summary, the electrical connector 100 according to certain embodiments of the present invention, among other things, has the following beneficial advantages:

1. The insulation body has a first insulation portion 14 and a second insulation portion 15, the first insulation portion 14 and the second insulation portion 15 respectively protrude into the first hole 35 and the first grooves 34 of the middle grounding plate 3, so that the middle grounding plate 3 can be stably retained in the insulation body 1, avoiding a scenario of the middle grounding plate 3 being displaced during the process of the electrical connector 100 being plugged in the mating connector 200, thereby making the upper-row terminals and the lower-row terminals of the middle grounding plate 3 have a good shielding effect, and improving high-frequency performance of the electrical connector 100.

2. The first hole 35 is located between the two first grooves 34, and the first hole 35 overlaps the centerline L of the middle grounding plate 3 along an axis between front and rear ends of the middle grounding plate, and are bilaterally symmetric relative to the centerline L of the middle grounding plate 3, so that the middle grounding plate 3 is evenly forced, ensuring uniform strength of respective parts of the middle grounding plate 3.

3. The latch slots 36 are located closer to a front end of the middle grounding plate 3 than the first grooves 34 are, and the first grooves 34 are adjacent to the latch slots 36, and the first grooves 34 are closer to the centerline L of the middle grounding plate 3 than the latch slot 36 are, thus facilitating manufacturing process.

4. The middle grounding plate 3 is further provided with multiple second holes 37, the multiple second holes 37 are evenly distributed on the middle grounding plate 3, the multiple second holes 37 surround the first holes 35, and the third insulation portion 16 protrudes into the second holes 37, enhancing the retaining force of the insulation body 1 for the middle grounding plate 3, so that the middle grounding plate 3 is more stably retained in the insulation body 1.

5. The upper grounding plate 41 has the extending portion 412 covering an upper surface of the base 11, the lower grounding plate 42 has the stopping portion 422 adjoining a lower surface of the plastic block 13, which increases coverage of the inner metal shell 4, can more effectively prevent crosstalk caused by that electromagnetic radiation in the insertion space 501 from leaking backward to interfere tails of the terminals 2 when the electrical connector 100 transmits high-speed signals, and improves signal transmission quality of the electrical connector 100.

6. The middle grounding plate 3 has the vertical portion 32 located between the first rear portion 212 and the second rear portion 222, which effectively shields telecommunication interference between the first rear portions 212 and the second rear portions 222, and enhances signal transmission stability of the electrical connector 100.

7. The insulation body 1 is composed of the base 11, the tongue 12 and the plastic block 13, which reduces the difficulty of integrally forming the insulation body 1, improves the manufacturing speed of the insulation body 1, and saves the manufacturing cost of the electrical connector 100.

8. During assembly, the tongue 12 adopts a hot melting method to retain the terminals 2, which makes the terminals 2 not easy to tilt upward on the tongue 12, and prolongs the service life of the electrical connector 100.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, comprising:

an insulation body, having a base and a tongue located in a front end of the base;

a plurality of terminals, arranged in an upper row and a lower row, wherein terminals in the upper row are arranged on an upper surface of the tongue, and terminals in the lower row are arranged on a lower surface of the tongue; and a middle grounding plate, disposed in the base and extending to the tongue, located between the upper and lower rows of terminals, and having at least one first hole, wherein an edge of each of two lateral sides of the middle grounding plate is inwardly depressed to form a first groove and a latch slot, each of the first grooves is adjacent to a corresponding latch slot on the same lateral side of the middle grounding plate, each of the first grooves is connected with the corresponding latch slot on the same lateral side of the middle grounding plate, and the latch slots are located closer to a front end of the middle grounding plate than the first grooves are; and wherein the first hole is located between the two first grooves, the insulation body has a first insulation portion and a second insulation portion, the first insulation portion protrudes into the first hole, and the second insulation portion protrudes into the first grooves on the lateral sides.

2. The electrical connector according to claim 1, wherein the first grooves are closer to a centerline of the middle grounding plate along an axis between front and rear ends of the middle grounding plate than the latch slots are.

3. An electrical connector, comprising:

an insulation body, having a base and a tongue located in a front end of the base;

a plurality of terminals, arranged in an upper row and a lower row, wherein terminals in the upper row are arranged on an upper surface of the tongue, and terminals in the lower row are arranged on a lower surface of the tongue; and a middle grounding plate, disposed in the base and extending to the tongue, located between the upper and lower rows of terminals, and having at least one first hole, wherein an edge of each of two lateral sides of the middle grounding plate is inwardly depressed to form a first groove and a latch slot, and the latch slots are located closer to a front end of the middle grounding plate than the first grooves are;

wherein the first hole is located between the two first grooves, the insulation body has a first insulation portion and a second insulation portion, the first insulation portion protrudes into the first hole, and the second insulation portion protrudes into the first grooves on the lateral sides; and wherein each of the first grooves is provided with a first inner edge, a second inner edge and a third inner edge, the first inner edge is closer to a front side of the tongue than the second inner edge is, the third inner edge is connected between the first inner edge and the second inner edge, and each of the first inner edges of the first grooves is connected with a latch slot on the same lateral side of the middle grounding plate.

4. The electrical connector according to claim 3, wherein each of the first inner edge and the second inner edge is connected with the third inner edge through an arc-shaped connection portion.

5. The electrical connector according to claim 3, wherein a length of a projection of the first inner edge along an axis between front and rear ends of the middle grounding plate is less than a length of a projection of the second inner edge along the axis.

6. The electrical connector according to claim 3, wherein a distance between an inner sidewall of the first hole and a front end of the middle grounding plate is greater than a distance between the first inner edge and the front end of the middle grounding plate, and is smaller than a distance between the second inner edge and the front end of the middle grounding plate.

7. The electrical connector according to claim 1, wherein the first hole overlaps a centerline of the middle grounding plate along an axis between front and rear ends of the middle grounding plate, and is bilaterally symmetric relative to the centerline of the middle grounding plate.

8. The electrical connector according to claim 1, wherein the middle grounding plate and the tongue are insert-molded.

9. The electrical connector according to claim 1, wherein the middle grounding plate has a body portion disposed in the insulation body, the body portion has a first section located in the tongue and extends from the first section to form a second section located in the base, the first hole is disposed in the first section, and each of the first grooves is disposed in the first section and the second section.

10. The electrical connector according to claim 1, wherein the middle grounding plate is further provided with a plurality of second holes surrounding the first hole.

11. The electrical connector according to claim 10, wherein insulation body has a third insulation portion, and the third insulation portion protrudes into the second holes.

12. The electrical connector according to claim 3, wherein the first inner edge is closer to a front side of the tongue than the second inner edge is, the third inner edge is connected between the first inner edge and the second inner edge, and the second inner edge is perpendicular to the third inner edge.

13. The electrical connector according to claim 12, wherein the first inner edge is located in the tongue, and the second inner edge is located in the base.

14. The electrical connector according to claim 12, wherein the first hole has two fourth inner edges parallel to each other, and the third inner edge is parallel to the fourth inner edges.

15. The electrical connector according to claim 3, wherein the first grooves are closer to a centerline of the middle grounding plate along an axis between front and rear ends of the middle grounding plate than the latch slots are.

16. The electrical connector according to claim 3, wherein the first hole overlaps a centerline of the middle grounding plate along an axis between front and rear ends of the middle grounding plate, and is bilaterally symmetric relative to the centerline of the middle grounding plate.

17. The electrical connector according to claim 3, wherein the middle grounding plate and the tongue are insert-molded.

18. The electrical connector according to claim 3, wherein the middle grounding plate has a body portion disposed in the insulation body, the body portion has a first section located in the tongue and extends from the first section to form a second section located in the base, the first hole is disposed in the first section, and each of the first grooves is disposed in the first section and the second section.

19. The electrical connector according to claim 3, wherein the middle grounding plate is further provided with a plurality of second holes surrounding the first hole.

20. The electrical connector according to claim 19, wherein insulation body has a third insulation portion, and the third insulation portion protrudes into the second holes.

* * * * *